United States Patent [19]

Freese et al.

[11] 4,416,138

[45] Nov. 22, 1983

[54] EXTRUSION PRESS DIE CHANGE ASSEMBLY

[75] Inventors: Howard W. Freese, Rushville; Danil Lukach, Rochester, both of N.Y.

[73] Assignee: USM Corporation, Farmington, Conn.

[21] Appl. No.: 334,311

[22] Filed: Dec. 24, 1981

Related U.S. Application Data

[63] Continuation of Ser. No. 127,398, Mar. 5, 1980, abandoned.

[51] Int. Cl.[3] ..... B21C 35/04

[52] U.S. Cl. ..... 72/263; 72/255

[58] Field of Search ..... 72/255, 263, 273.5; 91/519

[56] References Cited

U.S. PATENT DOCUMENTS

| | | | |
|---|---|---|---|
| 2,858,017 | 10/1958 | Kent et al. | 72/263 |
| 3,025,959 | 3/1962 | Poleschuk | 72/255 |
| 3,150,772 | 9/1964 | Gayetsky | 72/263 |
| 3,431,765 | 3/1969 | Lombard | 72/255 |
| 3,543,557 | 12/1970 | Lomas | 72/263 |
| 3,760,689 | 9/1973 | Johnston | 91/519 |
| 3,805,575 | 4/1974 | Robra et al. | 72/255 |
| 3,844,151 | 10/1974 | Huertgen | 72/263 |
| 4,103,529 | 8/1978 | Huertgen et al. | 72/255 |

FOREIGN PATENT DOCUMENTS

| | | | |
|---|---|---|---|
| 480201 | 2/1938 | United Kingdom | 72/255 |

*Primary Examiner*—Lowell A. Larson

*Attorney, Agent, or Firm*—Vincent A. White

[57] ABSTRACT

An extrusion press having a die slide assembly capable of shearing the extrusion in the die, and transporting the die to a side movable transfer table for change thereof, the assembly eliminating excessive projection beyond the confines of the extrusion press of die transport equipment. The die slide assembly includes a first hydraulic cylinder for shearing an extrusion from the die, and a second hydraulic cylinder mounted adjacent the first cylinder for transporting the die and die holder to a transfer station on the side of said platen, permitting an exchange of the die holder die therewith, when necessary. The second hydraulic cylinder is movable with the die slide assembly to minimize the length requirements of the second hydraulic unit and still effectuate full traverse of the die holder.

1 Claim, 2 Drawing Figures

EXTRUSION PRESS DIE CHANGE ASSEMBLY

This application is a continuation of application Ser. No. 127,398, filed Mar. 5, 1980, and now abandoned.

BACKGROUND OF THE INVENTION (1) Field of the Invention

This invention relates to extrusion presses, and more particularly to die transfer mechanisms on extrusion presses.

(2) Description of Prior Art

An extrusion press is utilized to force a heated metal slug or billet through a shaped orifice called a die stack. The die stack is mounted in a carrier which may in turn be supported on a horizontal track or gibs fixed to a massive vertically arranged platen. The die is aligned with a passageway or egress hole in the plate or platen which provides reinforcement thereagainst, while permitting the metal to be forced and extruded therethrough. It is necessary to change the die from time to time to permit changes in the extrusion pattern, or to replace a worn die. Several methods have been proposed in the art and are shown in U.S. Pat. Nos. 2,858,017 to Kent et al; and 3,653,247; 3,844,151 and 4,103,529 to Huertigen. The patent to Kent et al, discloses a die shifter having a first cylinder mounted on the side of the platen adjacent and connected to a die slide assembly, with a second cylinder attached to the platen with a rod which pulls on the bottom of the die slide assembly. Both the first and second cylinders are used to shear the extruded article, whereupon the second cylinder is used to shift the slide slightly from in front of the orifice in the platen to enable an operator to lift the die out through the top of the slide using a crane or the like, and replacing it similarly. The '247 patent to Huertigen shows a die slide with empowering means therefor extending distantly off one side of the press. The '151 patent to Huertigen shows a die slide arrangement using a chain and sprockets adapted to move a die in conjunction with hydraulic unit, to a transfer station. This type of die shifting mechanism is susceptible to contamination from metal particles and necessitates constant cleaning and maintenance of the hydraulic unit components.

It is an object of the present invention to provide a die slide assembly which is compact and unobtrusive.

It is a further object of the present invention to provide a die slide assembly which does not require constant cleaning and maintenance as would some of the prior art.

BRIEF SUMMARY OF THE INVENTION

The present invention comprises a die slide assembly for an extrusion press, the slide assembly including a die seated in a die holder, which die holder is movably supported on a track adjacent one of the platens in the extrusion press. The die holder is shuttleable to a convenient die transfer station on one side of the platen by a dual hydraulic piston and cylinder arrangement. One of the hydraulic cylinders is arranged to be carried by the shuttle mechanism itself to reduce the length of cylinder required to complete the die transfer to the side of the platen. By carrying one of the hydraulic units on the shuttle itself, the length of the piston rod and cylinders is reduced considerably. This design minimizes the overall width requirements for the extrusion press, as well as simplifies the maintenance and operating procedures therefor, by eliminating or restricting portions of the hydraulic unit that would be otherwise exposed to contamination from the scraps generated during extrusion of billets in the machine.

BRIEF DESCRIPTION OF THE DRAWINGS

The objects and advantages of the present invention will become more apparent when viewed in conjunction with the following drawings, in which.

DESCRIPTION OF THE PREFERRED EMBODIMENT

Figure 1:
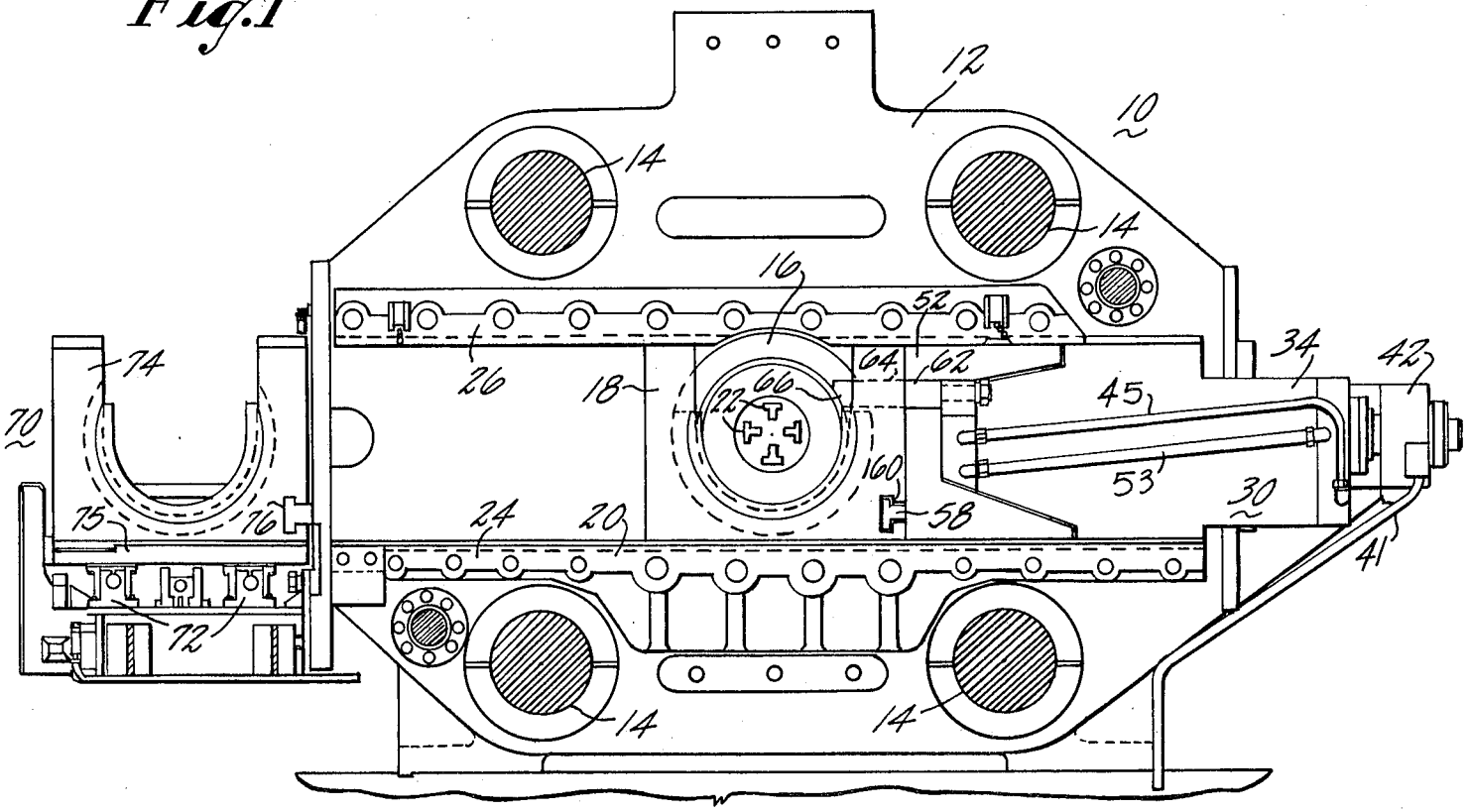
FIG. 1 is an elevational view of a die slide assembly for an extrusion press constructed according to the principles of the present invention.
Figure 2:
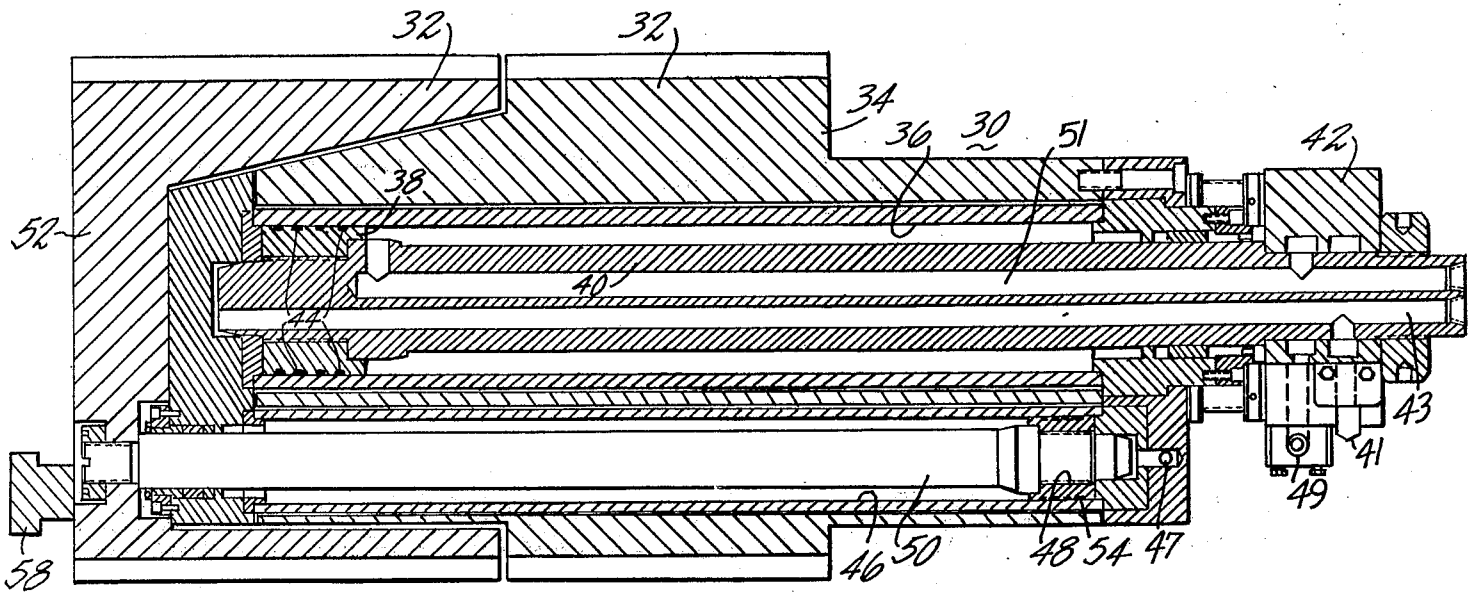
FIG. 2 is a sectional elevational view of the empowering means of the die slide assembly.

Referring now to the drawings in detail, and particularly to FIG. 1, there is shown a portion of an extrusion press 10 comprising a heavy front platen 12 and a heavy rear platen with a main press cylinder mounted therebetween, not shown, the front and rear platesn being connected by an arrangement of four tie rods 14 that take up the thrust of the extrusion operation therebetween. A die stack 16 is supported in a U-shaped die stack holder 18. The die stack holder 18 is movably disposed in a die slide assembly 20. The die stack 16 is of cylindrical configuration, configured orifice(s) having at least one configured orifice 22 which is in line with an orifice or egress hole extending through the front platen 12. The die slide assembly 20 includes a lower support track or gib 24 and an upper support track or gib 26 both attached to and extending off of the rear or inwardly directed face of the front platen 12. An empowering means 30, shown in section in FIG. 2, is arranged to mate with the die slide assembly 20. The empowering means 30 comprises a two-piece frame assembly 32 which is movable transversely of the front platen 12. The frame assembly 32 includes a primary slide block 34. The primary slide block 34 supportively encloses a pressurizable main cylindrical housing 36. A main piston head 38 is slidably arranged within the main housing 36, on a main piston rod 40. The end opposite the piston head 38 of the main piston rod 40 is securely connected to an arm 42 attached to the front platen 12. The main piston head 38 has a plurality of piston rings or seals 44 disposed thereon to prevent pressurizable fluid from seeping therepast. The primary slide block 34 also supportively encloses and secures a pressurizable secondary cylindrical housing 46. A secondary piston head 48 having a plurality of piston rings or seals 54 thereon, is slidably arranged within the secondary cylindrical housing 46, on the distal end of a secondary piston rod 50. The end opposite the piston of the secondary piston rod 50 is connected to a transport slide block 52. The transport slide block 52 and the primary slide block 34 are both arranged in a sliding relationship between the upper and lower support tracks or gibs 26 and 24, and they are in close proximity with one another when both piston heads 38 and 48 are fully retracted in their respective housing 36 and 46.

A "T"-key 58 is secured to the lower edge of the side face of the transport slide block 52. A "T"-slot 60, as shown in FIG. 1, is disposed in the lower portion of one side of the die holder 18. A die hold-down finger 62 is attached to the face of the primary slide block 34. The hold-down finger 62 is disposed parallel to and is spaced apart from the face of the transport slide block 52, and extends through a bore 64 in the die holder 18, permitting it to provide hold-down support to the die stack 16 when a shear blade, not shown, is lifted from alongside the die stack 16. The projecting end of the hold-down finger 62 has a curvilinear or angular surface 66 thereon to contact the periphery of the die ring of the die stack 16 thereadjacent.

A die transfer station 70 is disposed on the side of the front platen 12, opposite the side of the arm 42. The die transfer station 70 comprises a lower support track 72 which may be arranged perpendicular to the die slide assembly 20. A transfer table 75 is slidably mounted on the support track 72, at the level of the die slide assembly 20, which assembly may intersect the lower support track 72 at roughly its mid-point. The transfer table 75 may have another U-shaped die stack holder 74 slidably arranged thereon, and may include a die holder shuttle assembly, such as pressurized cylinders or the like, not shown, for moving the transfer table 75 with the first and/or the second die holder 18 or 74 therewith. It is to be noted that the second die holder 74 has a "T"-slot 76 near the bottom on one side thereof.

In operation of the extrusion press 10, the main press cylinder forces a ram, not shown, to push a billet or slug of material to be extruded through the configured orifice 22 in the die stack 16. The forces generated in the die stack 16 are directed through the die stack holder 18 and the massive front platen 12. The tie rods 14, which are secured to a frame supporting the ram and to the rear platen, not shown, absorb the stresses generated in the extrusion press 10. The tail end of extruded billet may be cut off by a vertically arranged shear, not shown, which shear may be disposed above the die 16 adjacent the middle of the platen 12. When the vertically arranged shear is lifted, there is a drag between it and the face of die stack 16 which tends to lift the die stack 16 in the die stack holder 18. The die hold-down finger 62 prevents vertical movement of the die stack 16 during this portion of the operation.

When a die is to be changed, fluid under pressure from a suitable fluid pressure source, not shown, may be delivered to the proximal end of the main piston shaft 40 through a conduit 41 and passage 43 causing the entire frame assembly 32 to extend to the left as seen in FIG. 2 along the main piston shaft 40 and to traverse across the front platen 12 along the die slide assembly 20. Any extrusion remaining within the die orifice 22 and the coaxial opening in the front platen is sheared off at the plane therebetween. Fluid under pressure may be delivered from the end of cylindrical housing 36 through a conduit 45 (FIG. 1) and a passage 47 (FIG. 2), against the secondary piston head 48 within the secondary cylindrical housing 46, either during pressurization of the main cylindrical housing 36, or after that occurrence, to effect movement of the secondary piston rod 50 out of the primary slide block 34, to cause continued transverse movement of the transport slide block 52 and the die stack 16 and die stack holder 18 thereattached. The die hold-down finger 62 is retracted from its position adjacent the die periphery and is withdrawn through the bore 64 in the die stack holder 18 as the transport slide block 52 is separated from its position adjacent the primary slide block 34. The die stack 16 and the die stack holder 18 can be transferred to the transfer table 75 mounted on the support track 72 on the side of the platen 12.

The transfer table 75 may then be moved by a pressurizable piston and cylinder unit, not shown, away from its association with the transport slide block 52, thus disengaging the die stack holder 18 therefrom by sliding the "T"-slot 60 away from its position enclosing the "T"-key 58, permitting subsequent servicing of the disengaged die stack 18. The new die holder 74, with whatever die may be arranged therewith, none being shown, may be attached to the transport slide block 52 by slidably mating the "T"-slot 76 in the new die holder 74 with the "T"-key 58. Retracting the secondary and primary piston rods 50 and 40, within their respective housings by exhausting fluid pressure from conduit 41 and delivering fluid pressure through a conduit 49, passage 51 and conduit 53 leading from the conduit 49 to the left end of housing 46, effects displacement of the new die holder 74 and whatever die is associated therewith to its proper position at the extrusion position adjacent the front platen 12.

Thus, there has been shown an extrusion press having a die transfer system which eliminates an excessive projection of pressurizable cylinders from the sides of the platen, and which permits a relatively easily maintainable and efficient die shearing operation free from the contamination and size problems associated with the prior art extrusion press machines.

It is intended that the appended claims for the present invention be interpreted as exemplary only, and not in a limiting sense.

We claim:

1. An extrusion press having a platen against which a die is supported for extrusion of material therethrough; a holder for the die having an open side through which the die is movable and mounted for sliding movements along the platen between an extrusion position and a die transfer station; a two part assembly mounted on the platen for sliding movements with the holder, the assembly including a primary slide containing a main cylinder and a secondary cylinder; a main piston having a rod extending in one direction through one end of the main cylinder and being secured to the platen; a secondary piston having a rod extending in the opposite direction through the opposite end of the secondary cylinder, the secondary piston rod being fixed to a secondary slide forming part of the assembly and being detachably secured to the holder; the cylinders being arranged so that when the main and secondary pistons and rods are fully retracted in their respective cylinders, the holder and die are located in extrusion position, and when the main and secondary pistons and rods are fully extended, the secondary slide is moved away from the primary slide and the holder and die are located at the transfer station; the holder having an open side through which the die is movable, the holder also having a bore through which a finger attached to the primary slide projects into retaining engagement with a die in the holder, the finger being retracted to release the die when the secondary slide is moved away from the primary slide.

* * * * *